US012807373B2

(12) United States Patent
Tanoue et al.

(10) Patent No.: US 12,807,373 B2
(45) Date of Patent: Nov. 24, 2026

(54) FITTING CONNECTOR AND BAG BODY WITH FITTING CONNECTOR

(71) Applicant: C.I. TAKIRON Corporation, Osaka (JP)

(72) Inventors: Naoto Tanoue, Osaka (JP); Shin Takagawa, Osaka (JP)

(73) Assignee: C.I. TAKIRON Corporation, Osaka (JP)

( * ) Notice: Subject to any disclaimer, the term of this patent is extended or adjusted under 35 U.S.C. 154(b) by 22 days.

(21) Appl. No.: 18/852,254

(22) PCT Filed: Mar. 17, 2023

(86) PCT No.: PCT/JP2023/010744
§ 371 (c)(1),
(2) Date: Sep. 27, 2024

(87) PCT Pub. No.: WO2023/189772
PCT Pub. Date: Oct. 5, 2023

(65) Prior Publication Data

US 2025/0206505 A1 Jun. 26, 2025

(30) Foreign Application Priority Data

Mar. 31, 2022 (JP) ..... 2022-060134

(51) Int. Cl.
*B65D 33/25* (2006.01)

(52) U.S. Cl.
CPC ..... *B65D 33/2541* (2013.01)

(58) Field of Classification Search
CPC ..... B65D 33/2541
(Continued)

(56) References Cited

U.S. PATENT DOCUMENTS 5,242,516 A * 9/1993 Custer ..... B29C 66/1122 24/581.1
5,415,904 A * 5/1995 Takubo ..... B65D 33/2541 24/585.12
(Continued)

FOREIGN PATENT DOCUMENTS

CN 102753448 B 6/2014
JP 06122460 A 5/1994
(Continued)

OTHER PUBLICATIONS

Office Action, dated May 20, 2025, for Japanese Patent Application No. 2022-060134. (6 pages) (with English Translation).
(Continued)

*Primary Examiner* — Peter N Helvey
(74) *Attorney, Agent, or Firm* — Seed Intellectual Property Law Group LLP

(57) ABSTRACT

A fitting tool and a fitting-tool-equipped bag body are provided that are capable of suppressing generation of wrinkles during bag making and responding to the demand for mono-materialization. A fitting tool (1) includes a male side fitting member (10) in which a male side fitting portion (12) is provided on a surface (11*a*) of a band-shaped first base material (11) along a longitudinal direction, and a female side fitting member (20) in which a female side fitting portion (22) is provided on a surface (21*a*) of a band-shaped second base material (21) along the longitudinal direction, in which the male side fitting portion (12) and the female side fitting portion (22) are detachably fit, each of the first base material (11) and the second base material (21) includes a main layer, a seal layer provided on a side of the main layer opposite the male side fitting portion (12) and the female side fitting portion (22), and an interlayer provided between the main layer and the seal layer, both the first base material (11) and the second base material (21) are formed
(Continued)

of a polyethylene-based resin obtained by polymerizing a monomer containing ethylene, and a rigidity obtained by a required measurement method is 5 to 30 N/mm.

6 Claims, 4 Drawing Sheets

(58) Field of Classification Search
USPC ..... 383/63
See application file for complete search history.

(56) References Cited

U.S. PATENT DOCUMENTS

| | | | | |
|---|---|---|---|---|
| 5,520,463 | A * | 5/1996 | Tilman | B65D 33/2541 383/63 |
| 6,092,931 | A * | 7/2000 | Tilman | B29C 66/723 383/63 |
| 7,077,570 | B2 * | 7/2006 | Fukumori | B29D 5/10 24/585.12 |
| 7,736,058 | B2 * | 6/2010 | Tanaka | B65D 33/2508 24/585.12 |
| 8,540,428 | B2 | 9/2013 | Nanba et al. | |
| 11,542,065 | B2 * | 1/2023 | Todaka | B31B 70/645 |
| 2012/0314978 | A1 | 12/2012 | Tamaoki et al. | |
| 2013/0343676 | A1 * | 12/2013 | Dais | B65D 33/25865 383/33 |
| 2014/0161374 | A1 * | 6/2014 | Septien Rojas | B65D 33/2508 383/63 |
| 2016/0101904 | A1 * | 4/2016 | Takigawa | B65D 33/2566 24/30.5 R |
| 2018/0086508 | A1 * | 3/2018 | Namba | B32B 27/32 |
| 2018/0257820 | A1 * | 9/2018 | Tameda | B65D 33/08 |
| 2021/0179322 | A1 | 6/2021 | Todaka | |

FOREIGN PATENT DOCUMENTS

| | | | |
|---|---|---|---|
| JP | 2003160147 | A | 6/2003 |
| JP | 2011155996 | A | 8/2011 |
| JP | 2018034899 | A | 3/2018 |
| JP | 2019176996 | A | 10/2019 |
| JP | 2021168783 | A | 10/2021 |
| TW | 467848 | B | 12/2001 |
| TW | 202031561 | A | 9/2020 |
| WO | 2013052742 | A1 | 4/2013 |
| WO | WO 2019111911 | A1 | 6/2019 |

OTHER PUBLICATIONS

International Search Report, mailed Jun. 6, 2023, for corresponding International Application No. PCT/JP2023/010744 (4 pages).
Office Action, dated May 22, 2026, for Taiwanese Patent Application No. 112109920. (31 pages) (with English Translation).
Extended European Search Report, mailed Jan. 23, 2026, for European Patent Application No. 23779788.1. (10 pages).

* cited by examiner

FITTING CONNECTOR AND BAG BODY WITH FITTING CONNECTOR

TECHNICAL FIELD

The present invention relates to a fitting tool and a fitting-tool-equipped bag body.

Priority is claimed on Japanese Patent Application No. 2022-060134, filed Mar. 31, 2022, the content of which is incorporated herein by reference.

BACKGROUND ART

In various fields such as food, chemicals, general goods, and the like, a fitting-tool-equipped bag body in which a fitting tool that opens and closes an opening portion is attached to an inner surface of a bag main body in the vicinity of the opening portion is widely used. As the fitting tool, a fitting tool in which a first fitting portion and a second fitting portion that are detachably fit to each other are provided on facing surfaces of a pair of band-shaped base materials along a longitudinal direction of the base materials (for example, Patent Document 1) is an exemplary example.

In recent years, there has been a demand for reusing plastic after use, starting with the marine plastic problem. Also for packaging bodies, from the viewpoint of improving recyclability, an approach of so-called "mono-materialization" in which a packaging body is configured with a single material has been made. However, in a case where a fitting tool configured with a polyethylene-based resin is heat-sealed to a bag main body configured with a polyethylene-based film, there is a problem in that thermal shrinkage occurs and a bag body is likely to be wrinkled.

In order to solve the problem that wrinkles are generated in the bag body during heat sealing, as a fitting tool of the related art, a fitting tool in which layers formed of a resin having a high hardness are provided on a portion of a pair of band-shaped base materials is an exemplary example. As a specific example, a fitting tool in which a layer formed of a polyethylene or polypropylene resin is used on front and rear surfaces of a base material, and an interlayer formed of a nylon or polyester resin having a higher hardness than front and rear surface layers is used between the front and rear surface layers is an exemplary example (for example, Patent Document 2).

CITATION LIST

Patent Document

Patent Document 1: Japanese Unexamined Patent Application, First Publication No. 2003-160147

Patent Document 2: Japanese Unexamined Patent Application, First Publication No. H06-122460

SUMMARY OF INVENTION

Technical Problem

However, a fitting tool of the related art, as described in Patent Document 2, has an effect of suppressing generation of wrinkles during bag making, but is not configured with a single resin. Therefore, the fitting tool cannot respond to the demand for recycling, particularly, mono-materialization.

The present invention has been made in view of such circumstances, and an object of the present invention is to provide a fitting tool capable of suppressing generation of wrinkles during bag making and responding to the demand for mono-materialization. Another object is to provide a fitting-tool-equipped bag body using such a fitting tool.

Solution to Problem

The present invention includes the following aspects.

[1]A fitting tool including a male side fitting member in which a male side fitting portion is provided on a surface of a band-shaped first base material along a longitudinal direction, and a female side fitting member in which a female side fitting portion is provided on a surface of a band-shaped second base material along the longitudinal direction, in which the male side fitting portion and the female side fitting portion are detachably fit, each of the first base material and the second base material includes a main layer, a seal layer provided on a side of the main layer opposite the male side fitting portion and the female side fitting portion, and an interlayer provided between the main layer and the seal layer, both the first base material and the second base material are formed of a polyethylene-based resin obtained by polymerizing a monomer containing ethylene, and a rigidity obtained by the following measurement method is 5 to 30 N/mm.

[Rigidity]

The male side fitting member is cut out to have a length of 70 mm to obtain a test piece.

Both ends of the obtained test piece in the longitudinal direction are gripped by a tensile testing machine, and a tensile stress at 2% elongation is measured. A tensile stress is measured for five test pieces, and an arithmetic average value of measured values is adopted as the tensile stress (rigidity). A peel strength is measured under conditions of a chuck distance of 50 mm and a test speed of 1 mm/min.

[2] The fitting tool according to [1], in which the rigidity is 7 to 15 N/mm.

[3] The fitting tool according to [1] or [2], in which the polyethylene-based resin forming the interlayer has a density of 930 kg/m$^3$ or more.

[4] The fitting tool according to any one of [1] to [3], in which the polyethylene-based resin forming the interlayer has a melting point of 125° C. or higher.

[5]A fitting-tool-equipped bag body including the fitting tool according to any one of [1] to [4], and a bag main body that accommodates a content, in which the bag main body is formed of a polyethylene-based resin obtained by polymerizing a monomer containing ethylene, and the fitting tool is attached to an inner surface of the bag main body.

Advantageous Effects of Invention

According to the present invention, it is possible to provide a fitting tool capable of suppressing the generation of wrinkles during bag making and responding to the demand for mono-materialization. In addition, it is possible to provide a fitting-tool-equipped bag body using such a fitting tool.

The fitting tool and the fitting-tool-equipped bag body of the present invention are configured with the polyethylene-based resin (that is, a single resin). Therefore, it is not necessary to separate the fitting tool from the bag body in a case of reuse, and recycling efficiency is good.

DESCRIPTION OF EMBODIMENTS

[Fitting Tool]

Figure 1:
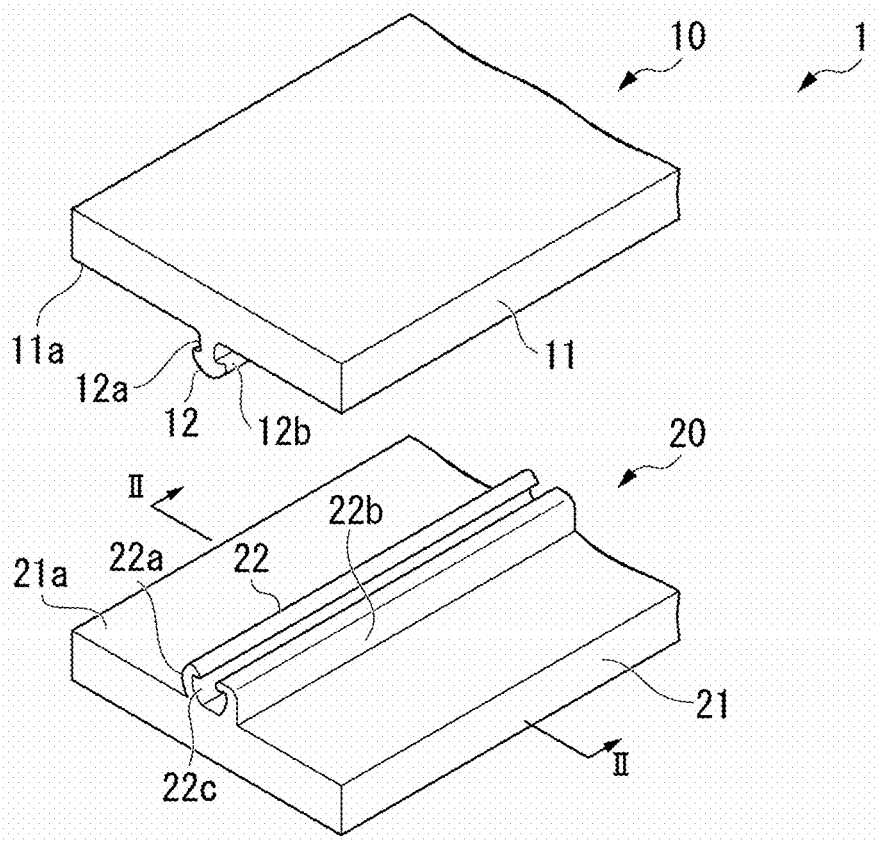
FIG. 1 is a schematic perspective view showing a fitting tool of the present embodiment.

Hereinafter, an example of a fitting tool of the present invention will be described with reference to the drawings. The dimensions and the like in the drawings illustrated in the following description are merely examples, and the present invention is not limited thereto. As long as the gist of the present invention is not changed, the present invention can be embodied by appropriately modifying the dimensions and the like.

Figure 2:
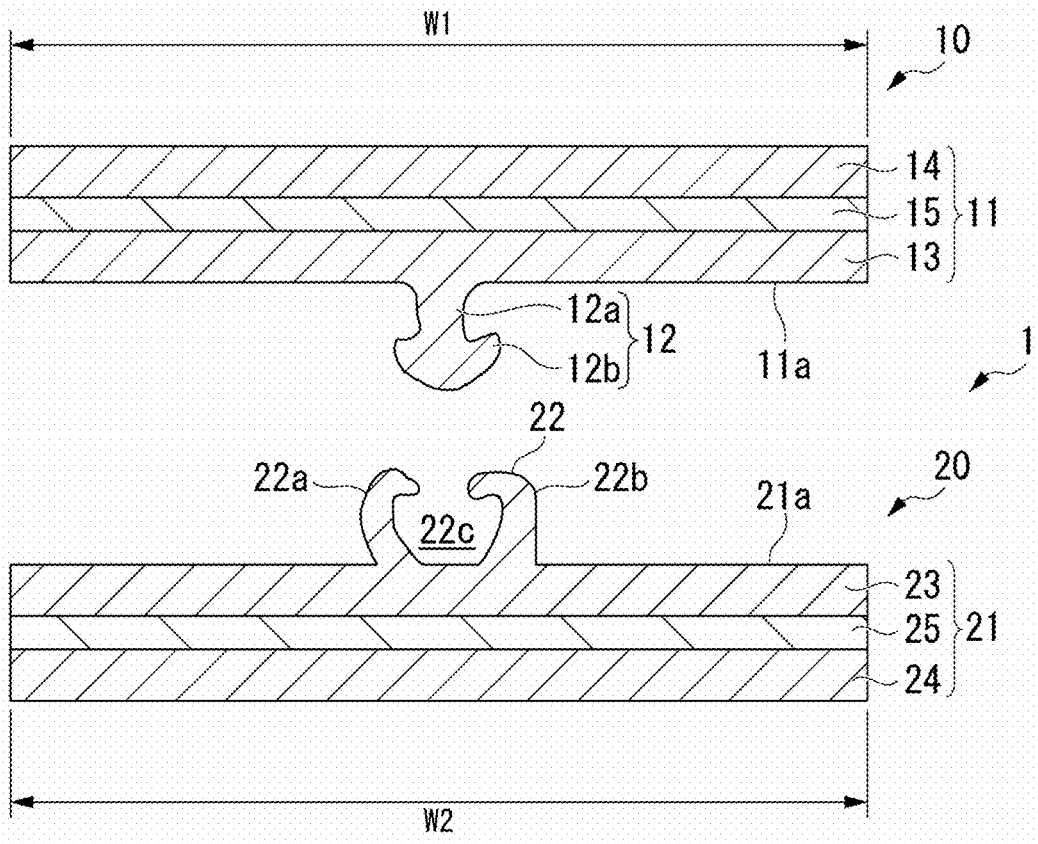
FIG. 2 is an arrow cross-sectional view taken along the line II-II of FIG. 1.

As shown in FIGS. 1 and 2, a fitting tool 1 of an example of an embodiment includes a male side fitting member 10 in which a male side fitting portion 12 is provided on a surface 11*a* of a band-shaped first base material 11 along a longitudinal direction, and a female side fitting member 20 in which a female side fitting portion 22 is provided on a surface 21*a* of a band-shaped second base material 21 along a longitudinal direction.

The male side fitting portion 12 of an example shown in FIGS. 1 and 2 includes a main stem portion 12*a* that stands up from the surface 11*a* of the first base material 11, which is a surface facing the second base material 21, and a head portion 12*b* that is provided at a distal end portion of the main stem portion 12*a* and has a substantially semi-circular cross section which is larger than the main stem portion 12*a*. The female side fitting portion 22 includes a pair of arm portions 22*a* and 22*b* that stand up from the surface 21*a* of the second base material 21, which is a surface facing the first base material 11, in a cross-sectional arc shape, and a recessed portion 22*c* is formed on the inside of the arm portions 22*a* and 22*b*.

The male side fitting portion 12 and the female side fitting portion 22 are detachably fit to each other by fitting the head portion 12*b* of the male side fitting portion 12 into the recessed portion 22*c* of the female side fitting portion 22. An aspect of the male side fitting portion 12 and the female side fitting portion 22 may be detachably fit to each other, and is not limited to the aspect of FIGS. 1 and 2.

As shown in FIG. 2, the first base material 11 includes a main layer 13, a seal layer 14 provided on a side of the main layer 13 opposite the male side fitting portion 12 and the female side fitting portion 22, and an interlayer 15 provided between the main layer 13 and the seal layer 14.

A material for forming the main layer 13 is a polyethylene-based resin obtained by polymerizing a monomer containing ethylene. The monomer containing ethylene is not particularly limited, and may be derived from a fossil fuel or derived from a biomass.

In the present specification, the expression "derived from a biomass" is used to distinguish from a material derived from a fossil fuel, and refers to an "organic resource derived from a living organism, excluding a fossil fuel". The fossil fuel corresponds to coal, petroleum, and natural gas.

The "polyethylene-based resin" refers to a polymer having a polyethylene structure derived from ethylene as a constitutional unit of a main component. In addition, the expression "the constitutional unit of the main component" refers to a constitutional unit which occupies more than 50% by mass with respect to 100% by mass of all constitutional units constituting the resin. In the following description, the polyethylene-based resin forming the main layer 13 may be abbreviated as "polyethylene (A)".

(Polyethylene (A))

The polyethylene (A) may further have a constitutional unit derived from α-olefin in addition to the constitutional unit derived from ethylene. The α-olefin may be derived from a biomass or may be derived from a fossil fuel.

As the α-olefin, at least one kind selected from the group consisting of propylene, 1-butene, 1-pentene, 1-hexene, 1-octene, 1-heptene, 4-methyl-1-pentene, 4-methyl-1-hexene, and 4,4-dimethyl-1-pentene may be used. That is, in a case where the polyethylene (A) is a polymer having a constitutional unit derived from ethylene and a constitutional unit derived from α-olefin, the polyethylene (A) may be a binary copolymer of ethylene and one kind of polyolefin, a ternary copolymer of ethylene and two kinds of polyolefin, or a copolymer of ethylene and three or more kinds of polyolefin.

In addition, the polyethylene (A) may have a constitutional unit derived from a monomer other than ethylene and α-olefin, as long as the effect of the present invention is not impaired. A proportion of the other monomers in the polyethylene (A) as a whole is required to be less than 10%.

Examples of other monomers can include a vinyl ester, a methacrylic acid ester, an unsaturated carboxylic acid, an anhydride of an unsaturated dicarboxylic acid, an unsaturated dicarboxylic acid ester, (meth)acrylonitrile, styrene, and the like.

Examples of the vinyl ester can include vinyl acetate, and the like.

Examples of the methacrylic acid ester can include methyl (meth)acrylate, ethyl (meth)acrylate, propyl (meth)acrylate, butyl (meth)acrylate, and the like.

Examples of the unsaturated carboxylic acid can include (meth)acrylic acid, and the like.

Examples of the anhydride of the unsaturated dicarboxylic acid can include maleic anhydride, and the like.

Examples of the unsaturated dicarboxylic acid ester can include monomethyl maleate, dimethyl maleate, and the like.

Examples thereof include (meth)acrylonitrile, styrene, and the like.

The (meth)acrylic acid refers to an acrylic acid or a methacrylic acid. In addition, (meth)acrylonitrile refers to acrylonitrile or methacrylonitrile.

Specific examples of the polyethylene (A) include low-density polyethylene (LDPE), extremely low-density polyethylene, high-pressure method low-density polyethylene, medium-density polyethylene, high-density polyethylene, and linear low-density polyethylene (LLDPE), which is an ethylene-α-olefin copolymer. Among these, as the polyethylene (A) used in the main layer 13, the low-density polyethylene (LDPE) and the linear low-density polyethylene (LLDPE) are preferable.

The polyethylene (A) forming the main layer 13 may be one or more kinds thereof.

(Physical Property Value of Polyethylene (A))

The polyethylene (A) preferably has the following physical property values.

(Melt Flow Rate)

A melt flow rate (MFR) of the polyethylene (A) is preferably 0.5 g/10 min or more, more preferably 1.0 g/10 min or more, and still more preferably 1.5 g/10 min or more. In addition, the MFR of the polyethylene (A) is preferably 15 g/10 min or less, more preferably 12 g/10 min or less, and still more preferably 10 g/10 min or less.

The upper limit value and the lower limit value of the MFR of the polyethylene (A) can be combined arbitrarily. The MFR of the polyethylene (A) is, for example, preferably 0.5 g/10 min or more and 15 g/10 min or less.

In a case where the MFR of the polyethylene (A) is the lower limit value or more in the range described above, the fitting tool of the present embodiment is easily molded. In a case where the MFR of the polyethylene (A) is the upper limit value or less in the range described above, the polyethylene (A) is easy to handle.

The MFR of the resin in the present embodiment is a value measured under conditions of a temperature of 190° C. and a load of 2.16 kg according to JIS K 7210-1.

(Density)

A density of the polyethylene (A) is preferably 890 kg/m$^3$ or more and more preferably 905 kg/m$^3$ or more. In addition, the density of the polyethylene (A) is preferably 960 kg/m$^3$ or less, more preferably 950 kg/m$^3$ or less, still more preferably 940 kg/m$^3$ or less, and particularly preferably 935 kg/m$^3$ or less.

The upper limit value and the lower limit value of the density of the polyethylene (A) can be combined arbitrarily. The density of the polyethylene (A) is, for example, preferably 890 kg/m$^3$ or more and 940 kg/m$^3$ or less.

In a case where the density of the polyethylene (A) is the lower limit value or more in the range described above, the fitting tool of the present embodiment is easily molded. In a case where the density of the polyethylene (A) is the upper limit value or less of the range described above, the fitting tool of the present embodiment is flexible and has excellent feeling in use.

The density of the resin in the present embodiment is a value measured according to JIS K7112:1999 (ISO 1183: 1987).

(Melting Point)

A melting point of the polyethylene (A) forming the main layer 13 is preferably 95° C. or higher, and more preferably 100° C. or higher. In addition, the melting point of the polyethylene (A) forming the main layer 13 is preferably 140° C. or lower, and more preferably 135° C. or lower.

The upper limit value and the lower limit value of the melting point of the polyethylene (A) can be combined arbitrarily. The melting point of the polyethylene (A) forming the main layer 13 is, for example, preferably 95° C. or higher and 140° C. or lower.

In a case where the melting point of the polyethylene (A) forming the main layer 13 is the lower limit value or more in the range described above, the fitting tool of the present embodiment is easily molded. In addition, in a case where the melting point of the polyethylene (A) forming the main layer 13 is the upper limit value or less in the range described above, the flexibility is excellent and the handleability is excellent.

The melting point of the polyethylene (A) in the present embodiment is a value measured according to JIS K7121: 2012 (ISO 3146).

A material for forming the seal layer 14 is a polyethylene-based resin obtained by polymerizing a monomer containing ethylene. The monomer containing ethylene is not particularly limited, and may be derived from a fossil fuel or derived from a biomass. In addition, as the polyethylene-based resin, the polyethylene (A) described above may be used. Among these, as the polyethylene (A) used in the seal layer 14, the low-density polyethylene (LDPE) and the linear low-density polyethylene (LLDPE) are preferable.

The polyethylene (A) forming the seal layer 14 may be one kind or two or more kinds thereof. In addition, the polyethylene (A) forming the seal layer 14 may use the same resin as or a different resin from the polyethylene (A) forming the main layer 13.

In particular, as the polyethylene (A) forming the seal layer 14, a polyethylene-based resin having a low melting point is preferable because of excellent low-temperature heat sealability. Specifically, the melting point is preferably 125° C. or lower and more preferably 120° C. or lower.

A material for forming the interlayer 15 is a polyethylene-based resin obtained by polymerizing a monomer containing ethylene. The monomer containing ethylene is not particularly limited, and may be derived from a fossil fuel or derived from a biomass. In the following description, the polyethylene-based resin forming the interlayer 15 may be abbreviated as "polyethylene (B)".

(Polyethylene (B))

The polyethylene (B) may further have a constitutional unit derived from α-olefin in addition to the constitutional unit derived from ethylene. The α-olefin may be derived from a biomass or may be derived from a fossil fuel.

As the α-olefin, the examples of the polyethylene (A) are exemplary examples. That is, in a case where the polyethylene (B) is a polymer having a constitutional unit derived from ethylene and a constitutional unit derived from α-olefin, the polyethylene (B) may be a binary copolymer of ethylene and one kind of polyolefin, a ternary copolymer of ethylene and two kinds of polyolefin, or a copolymer of ethylene and three or more kinds of polyolefin.

In addition, the polyethylene (B) may have a constitutional unit derived from a monomer other than ethylene and α-olefin, as long as the effect of the present invention is not impaired. A proportion of the other monomers in the polyethylene (B) as a whole is required to be less than 10%.

As the other monomers, the examples of the polyethylene (A) are exemplary examples.

As specific examples of the polyethylene (B), medium-density polyethylene, high-density polyethylene (HDPE), and the like are exemplary examples. Among these, as the polyethylene (B) used in the interlayer 15, the high-density polyethylene (HDPE) is preferable.

The polyethylene (B) forming the interlayer 15 may be one kind or two or more kinds thereof.

(Physical Property Value of Polyethylene (B))

The polyethylene (B) preferably has the following physical property values.

(Melt Flow Rate)

A melt flow rate (MFR) of the polyethylene (B) is preferably 4.0 g/10 min or more, more preferably 5.0 g/10 min or more, and still more preferably 6.5 g/10 min or more. In addition, the MFR of the polyethylene (B) is preferably 25 g/10 min or less, more preferably 20 g/10 min or less, and still more preferably 15 g/10 min or less.

The upper limit value and the lower limit value of the MFR of the polyethylene (B) can be combined arbitrarily. The MFR of the polyethylene (B) is, for example, preferably 6.5 g/10 min or more and 15 g/10 min or less.

In a case where the MFR of the polyethylene (B) is the lower limit value or more in the range described above, curling of the fitting tool of the present embodiment is suppressed. In a case where the MFR of the polyethylene (B) is the upper limit value or less in the range described above, the polyethylene (B) is easy to handle.

(Density)

When the polyethylene (B) is polyethylene, a density of the polyethylene (B) is preferably 930 kg/m$^3$ or more and more preferably 950 kg/m$^3$ or more. In addition, the density of the polyethylene (B) is preferably 1000 kg/m$^3$ or less, more preferably 970 kg/m$^3$ or less, and still more preferably 965 kg/m$^3$ or less.

The upper limit value and the lower limit value of the density of the polyethylene (B) can be combined arbitrarily. The density of the polyethylene (B) is, for example, preferably 950 kg/m$^3$ or more and 970 kg/m$^3$ or less.

In a case where the density of the polyethylene (B) is the lower limit value or more in the range described above, the fitting tool of the present embodiment is easily molded. In a case where the density of the polyethylene (B) is the upper limit value or less of the range described above, the fitting tool of the present embodiment is flexible and has excellent feeling in use.

(Melting Point)

A melting point of the polyethylene (B) is preferably 120° C. or higher, and more preferably 128° C. or higher. In addition, the melting point of the polyethylene (B) is preferably 160° C. or lower, and more preferably 150° C. or lower.

The upper limit value and the lower limit value of the melting point of the polyethylene (B) can be combined arbitrarily. The melting point of the polyethylene (B) is, for example, preferably 128° C. or higher and 150° C. or lower.

In a case where the melting point of the polyethylene (B) is the lower limit value or more in the range described above, sufficient rigidity is obtained, and the fitting tool of the present embodiment is easily molded. In addition, in a case where the melting point of the polyethylene (B) is the upper limit value or lower in the range described above, the fitting tool has sufficient flexibility and toughness.

(Bending Elastic Modulus)

A bending elastic modulus of the polyethylene (B) is preferably 950 MPa or more and more preferably 1,000 MPa or more. In addition, the bending elastic modulus of the polyethylene (B) is preferably 1,500 MPa or less and more preferably 1,300 MPa or less.

The upper limit value and the lower limit value of the bending elastic modulus of the polyethylene (B) can be combined arbitrarily. The bending elastic modulus of the polyethylene (B) is, for example, preferably 1,000 MPa or more and 1,300 MPa or less.

In a case where the bending elastic modulus of the polyethylene (B) is the lower limit value or more in the range described above, the fitting tool has sufficient rigidity. In addition, in a case where the bending elastic modulus of the polyethylene (B) is the upper limit value or less in the range described above, the fitting tool has sufficient flexibility and toughness.

The bending elastic modulus of the polyethylene (B) in the present embodiment is a value measured according to JIS K 7171.

(Tensile Yield Stress)

A tensile yield stress of the polyethylene (B) is preferably 20 MPa or more and more preferably 25 MPa or more. In addition, the tensile yield stress of the polyethylene (B) is preferably 40 MPa or less and more preferably 35 MPa or less.

The upper limit value and the lower limit value of the tensile yield stress of the polyethylene (B) can be combined arbitrarily. The tensile yield stress of the polyethylene (B) is, for example, preferably 25 MPa or more and 35 MPa or less.

In a case where the tensile yield stress of the polyethylene (B) is the lower limit value or more in the range described above, the fitting tool has sufficient rigidity. In addition, in a case where the tensile yield stress of the polyethylene (B) is the upper limit value or less in the range described above, the fitting tool has sufficient flexibility and toughness.

The tensile yield stress of the polyethylene (B) in the present embodiment is a value measured according to JIS K 7161: 2014 (ISO 527-1).

The main layer 13, the seal layer 14, and the interlayer 15 can contain, as necessary, well-known additives such as a stabilizer, an antioxidant, a lubricant, an antistatic agent, a colorant, and a molding aid.

From the viewpoint that sufficient sealing strength is easily obtained when heat-welded to a bag body, a width W1 of the first base material 11 is preferably 2 mm or more and more preferably 3 mm or more. From the viewpoint of excellent flexibility and handleability, the width W1 of the first base material 11 is preferably 60 mm or less, and more preferably 40 mm or less. The lower limit and the upper limit of the width W1 of the first base material 11 can be combined arbitrarily, and are, for example, preferably 2 mm or more and 60 mm or less.

From the viewpoint of excellent balance of rigidity and flexibility, a thickness of the first base material 11 is preferably 0.01 mm or more and more preferably 0.12 mm or more. From the viewpoint of excellent flexibility and excellent feeling in use, the thickness of the first base material 11 is preferably 0.4 mm or less and more preferably 0.3 mm or less. The lower limit and the upper limit of the thickness of the first base material 11 can be combined arbitrarily, and are, for example, preferably 0.01 mm or more and 0.4 mm or less.

From the viewpoint of obtaining sufficient rigidity, a thickness of the main layer 13 is preferably 0.005 mm or more and more preferably 0.015 mm or more. From the viewpoint of excellent flexibility and handleability, the thickness of the main layer 13 is preferably 0.3 mm or less, and more preferably 0.2 mm or less. The lower limit and the upper limit of the thickness of the main layer 13 can be combined arbitrarily, and are, for example, preferably 0.005 mm or more and 0.3 mm or less.

From the viewpoint that sufficient sealing strength is obtained when heat-welded to a bag body, a thickness of the seal layer 14 is preferably 0.003 mm or more, more preferably 0.008 mm or more, and still more preferably 0.01 mm or more. From the viewpoint that the fitting tool is flexible and has excellent feeling in use, the thickness of the seal layer 14 is preferably 0.2 mm or less, more preferably 0.1 mm or less, and still more preferably 0.08 mm or less. The lower limit and the upper limit of the thickness of the seal layer 14 can be combined arbitrarily, and are, for example, preferably 0.003 mm or more and 0.2 mm or less.

A thickness of the interlayer 15 is preferably 0.02 mm or more, more preferably 0.03 mm or more, and still more preferably 0.05 mm or more. In addition, the thickness of the interlayer 15 is preferably 0.4 mm or less, more preferably 0.3 mm or less, and still more preferably 0.25 mm or less. The upper limit value and the lower limit value of the thickness of the interlayer 15 can be combined arbitrarily.

In a case where the thickness of the interlayer 15 is the lower limit value or more, sufficient sealing strength is obtained when the fitting tool is heat-welded to the bag body. Thus, the generation of wrinkles during the bag making can be suppressed.

In a case where the thickness of the interlayer 15 is the upper limit value or less, the fitting tool is flexible and has excellent feeling in use, and excellent point sealability is obtained. Here, "point sealability" refers to a property of preventing pinholes from being generated in a crushed portion in a point sealing step of crushing a fitting tool in a case of forming a side seal portion of a bag body.

The second base material 21 has the same configuration as the first base material 11, and includes a main layer 23, a seal layer 24 provided on a side of the main layer 23 opposite the male side fitting portion 12 and the female side fitting portion 22, and an interlayer 25 provided between the main layer 23 and the seal layer 24.

Materials forming the main layer 23, the seal layer 24, and the interlayer 25 are not particularly limited, and the same materials as those exemplified as the materials forming the main layer 13, the seal layer 14, and the interlayer 15 can be exemplary examples, and preferred aspects thereof are also the same.

The main layer 23, the seal layer 24, and the interlayer 25 can contain, as necessary, well-known additives such as a stabilizer, an antioxidant, a lubricant, an antistatic agent, a colorant, and a molding aid.

The materials forming the main layer 13, the seal layer 14, and the interlayer 15 may be the same as or different from the materials forming the main layer 23, the seal layer 24, and the interlayer 25.

A preferred width W2 of the second base material 21 is the same as the preferred width W1 of the first base material 11. The width W1 of the first base material 11 and the width W2 of the second base material 21 may be the same as or different from each other.

Preferred thicknesses of the second base material 21, the main layer 23, the seal layer 24, and the interlayer 25 are the same as the preferred thicknesses of the first base material 11, the main layer 13, the seal layer 14, and the interlayer 15. The thicknesses of the first base material 11, the main layer 13, the seal layer 14, and the interlayer 15 may be the same as or different from the thicknesses of the second base material 21, the main layer 23, the seal layer 24, and the interlayer 25.

A mass proportion of the main layer, the seal layer, and the interlayer in the entire fitting tool is preferably 10% by mass or more and 90% by mass or less for the main layer, 5% by mass or more and 30% by mass or less for the seal layer, and 5% by mass or more and 60% by mass or less for the interlayer, and more preferably 50% by mass or more and 85% by mass or less for the main layer, 8% by mass or more and 20% by mass or less for the seal layer, and 10% by mass or more and 45% by mass or less for the interlayer. Here, the mass proportion of the main layer, the seal layer, and the interlayer refers to a mass proportion of the resin contained in each layer, and a total mass proportion of the main layer, the seal layer, and the interlayer is 100% by mass. In a case where the mass proportion of the main layer, the seal layer, and the interlayer is within the range described above, excellent moldability is obtained and it is easy to suppress thermal shrinkage.

In the fitting tool 1 of the present embodiment, a rigidity obtained by an evaluation method described below is preferably 5 N/mm or more, more preferably 6 N/mm or more, and still more preferably 7 N/mm or more. In addition, the rigidity described above is preferably 30 N/mm or less, more preferably 25 N/mm or less, and still more preferably 15 N/mm or less.

The upper limit value and the lower limit value of the rigidity of the fitting tool 1 can be combined arbitrarily. The rigidity of the fitting tool 1 can be set to 5 N/mm or more and 30 N/mm or less.

In a case in which the rigidity of the fitting tool 1 is within the range described above, the rigidity of the fitting tool is sufficient, and in a case in which the fitting tool is applied to a fitting-tool-equipped bag body which will be described later, the generation of wrinkles during bag making can be suppressed.

[Rigidity]

The male side fitting member is cut out to have a length of 70 mm to obtain a test piece.

Both ends of the obtained test piece in the longitudinal direction are gripped by a tensile testing machine (manufactured by Toyo Seiki Seisaku-sho, Ltd., VGS5E), and a tensile stress at 2% elongation is measured. A tensile stress is measured for five test pieces, and an arithmetic average value of measured values is adopted as the tensile stress. A peel strength is measured under conditions of a chuck distance of 50 mm and a test speed of 1 mm/min.

In addition, in the fitting tool 1 of the present embodiment, when a melting point of the entire fitting tool is 120° C. or higher and a fusion heat amount thereof is set to 100%, it is preferable that a melting point heat amount of other peaks generated in a temperature range lower than 120° C. be 20% or less.

In a case where the melting point heat amount at the other peaks described above is 20% or less, the fitting tool 1 has sufficient rigidity and excellent moldability.

In addition, in the fitting tool 1 of the present embodiment, the density of the polyethylene (B) is larger than the density of the polyethylene (A). Specifically, the density of the polyethylene (B) is preferably 1.01 times or more, and more preferably 1.05 times or more the density of the polyethylene (A).

In a case where the density of the polyethylene (B) is 1.01 times or more the density of the polyethylene (A), sufficient sealing strength is obtained in a case where the fitting tool 1 of the present embodiment is heat-welded to the bag body. Therefore, the generation of wrinkles during the bag making can be suppressed.

In addition, in the fitting tool 1 of the present embodiment, the melting point of the polyethylene (B) is higher than the melting point of the polyethylene (A). Specifically, the melting point of the polyethylene (B) is preferably 1.01 times or more, and more preferably 1.07 times or more the melting point of the polyethylene (A).

In a case where the melting point of the polyethylene (B) is 1.01 times or more the melting point of the polyethylene (A), the fitting tool 1 of the present embodiment has sufficient rigidity and has low-temperature sealability. Therefore, the generation of wrinkles during the bag making can be suppressed.

(Manufacturing Method)

A method for manufacturing the fitting tool 1 is not particularly limited as long as the polyethylene (A) and the polyethylene (B) are used, and a known method can be adopted.

For example, the polyethylene (A) is obtained by mixing one or more kinds of polyethylene-based resin in suitable and necessary proportions, and performing melt-kneading at 150° C. to 200° C. (a temperature 40° C. to 50° C. higher than a melting point of resins to be blended) using a uniaxial extruder having a diameter of 50 mmϕ and an L/D of 30.

In addition, the polyethylene (B) is obtained by mixing one or more kinds of polyethylene-based resin in suitable and necessary proportions, and performing melt-kneading at 150° C. to 200° C. (a temperature 40° C. to 50° C. higher than a melting point of resins to be blended) using a uniaxial extruder having a diameter of 30 mmϕ and an L/D of 30.

The obtained polyethylene (A) and polyethylene (B) can be guided to a composite shape die of a male side fitting member or a female side fitting member, and co-extrusion-molded, and cooled by water cooling or air cooling to manufacture a fitting tool. The obtained fitting tool can be wound by a winder.

In addition, the male side fitting member 10 may be formed by integrally extrusion-molding the main layer 13 and the male side fitting portion 12 using the polyethylene (A), and providing the interlayer 15 by thermolaminating a laminate film made of the polyethylene (B) to another surface 11*b* of the first base material 11 of the obtained molded product.

In addition, the female side fitting member 20 may be formed by integrally extrusion-molding the main layer 23 and the female side fitting portion 22 using the polyethylene (A), and providing the interlayer 25 by thermolaminating a laminate film made of the polyethylene (B) to another surface 21*b* of the second base material 21 of the obtained molded product.

In the fitting tool 1 as described above, as a forming material, the polyethylene (A) and the polyethylene (B), which are formed of polyethylene-based resins, are used. Accordingly, since the fitting tool 1 is configured with a single resin (the polyethylene-based resin), the fitting tool 1 can respond to the demand for mono-materialization in recycling.

[Fitting-Tool-Equipped Bag Body]

Figure 3:
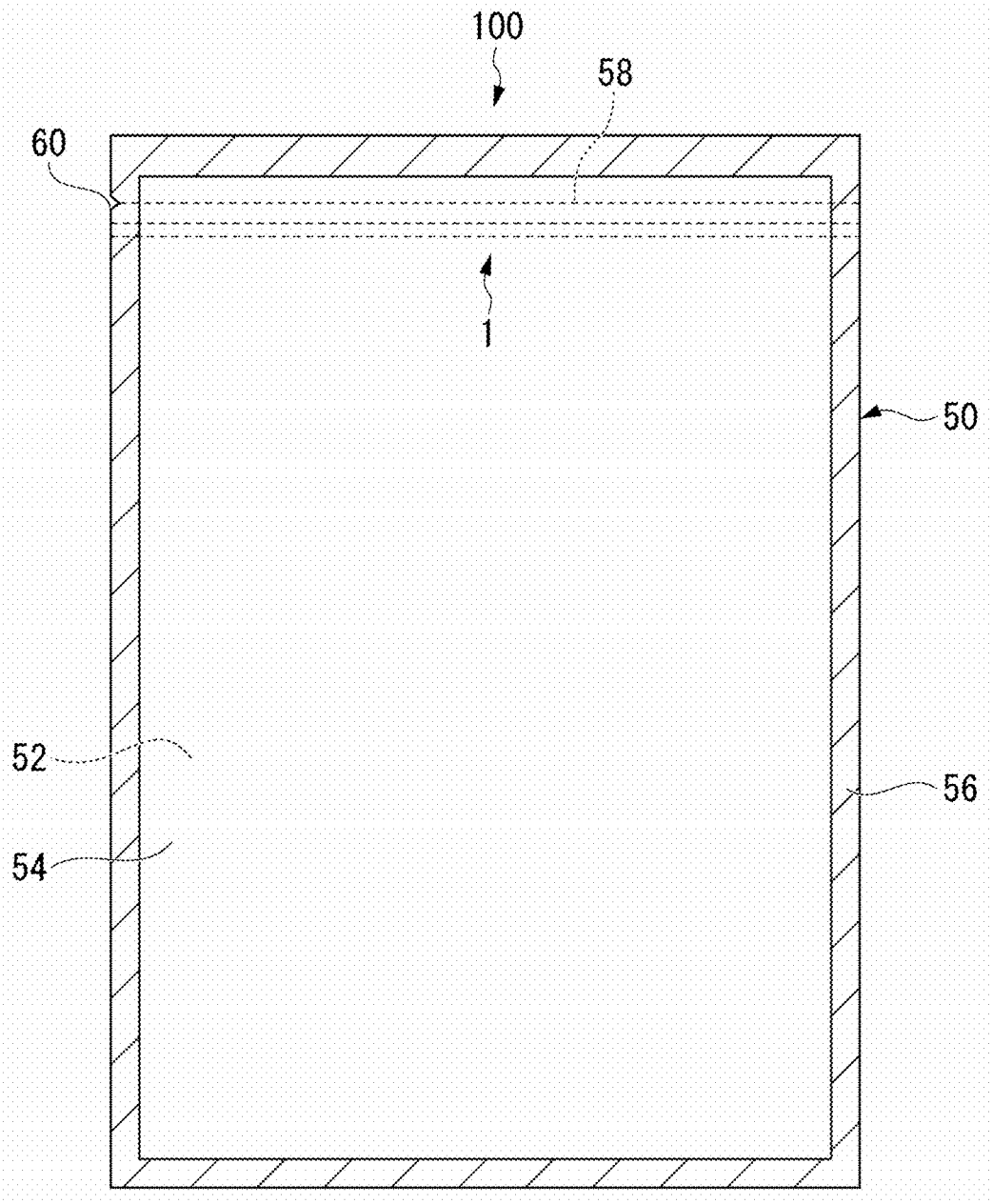
FIG. 3 is a schematic front view showing a fitting-tool-equipped bag body 100 of the present embodiment.

FIG. 3 is a schematic front view showing a fitting-tool-equipped bag body 100 of the present embodiment. In the following description, the fitting-tool-equipped bag body 100 may be simply abbreviated as the "bag body 100".

As shown in FIG. 3, the bag body 100 of the present embodiment includes a bag main body 50 and the fitting tool 1 attached to an inner surface of an upper portion in the bag main body 50.

The bag main body 50 has a rectangular shape in a front view. The fitting tool 1 is provided to extend in a short direction of the bag main body 50 on the inner surface of the upper portion side of the bag main body 50. A shape of the bag main body 50 is not limited to a rectangle.

The bag main body 50 is sealed in a state of enclosing a content (not shown). The bag main body 50 is obtained by superimposing a first film material 52 and a second film material 54 and heat-sealing all of four peripheral portions 56. In the peripheral portions 56, both ends of the fitting tool 1 are heat-sealed together with the first film material 52 and the second film material 54.

The first film material 52 and the second film material 54 may be capable of welding the fitting tool 1 by heat sealing, and a single-layer film formed of a sealant layer, or a laminated film including at least a sealant layer and a base material layer from the inner surface side can be used.

As the base material layer included in the laminated film, a polyethylene-based resin is used, and for example, the resin described for the polyethylene (A) or the polyethylene (B) is used. The polyethylene-based resin used in the base material layer may be one kind or two or more kinds thereof.

As the sealant layer included in the laminated film, a polyethylene-based resin is used, and for example, the resin described for the polyethylene (A) or the polyethylene (B) is used.

That is, the first film material 52 and the second film material 54 may be a laminated layer with different polyethylene-based resins.

A functional layer such as a barrier layer or the like may be provided in the laminated film.

In the fitting-tool-equipped bag body 100 of the present embodiment, linear low-density polyethylene (LLDPE) is preferably used as the sealant layers of the first film material 52 and the second film material 54. Accordingly, since the fitting-tool-equipped bag body 100 is configured with a single resin (the polyethylene-based resin), the fitting tool can respond to the demand for mono-materialization in recycling. In addition, the fitting tool can be heat-sealed at a low temperature, and the generation of wrinkles can be suppressed.

In the bag main body 50, a cutting assistance line 58 is provided on an upper side with respect to the fitting tool 1 along the fitting tool 1.

The cutting assistance line 58 is a portion that is processed linearly to assist the cutting of the bag main body 50. As the cutting assistance line 58, for example, a weakened line provided in a portion of the cutting assistance line 58 of the first film material 52 and the second film material 54 is an exemplary example. The weakened line can be formed by providing a thin portion in the film material with respect to the periphery. In addition, the weakened line can also be formed by perforations or a row of pores.

In addition, the cutting assistance line 58 is not limited to the weakened line, and may be a line formed by printing or the like, which indicates a position to be cut by scissors, a cutter, or the like.

A notch 60 is formed on an end portion of the cutting assistance line 58 of the peripheral portion 56. A shape of the notch 60 is not particularly limited, and a triangular or semicircular notch can be adopted. In addition, the notch 60 may be a notch provided in the peripheral portion 56.

Figure 4:
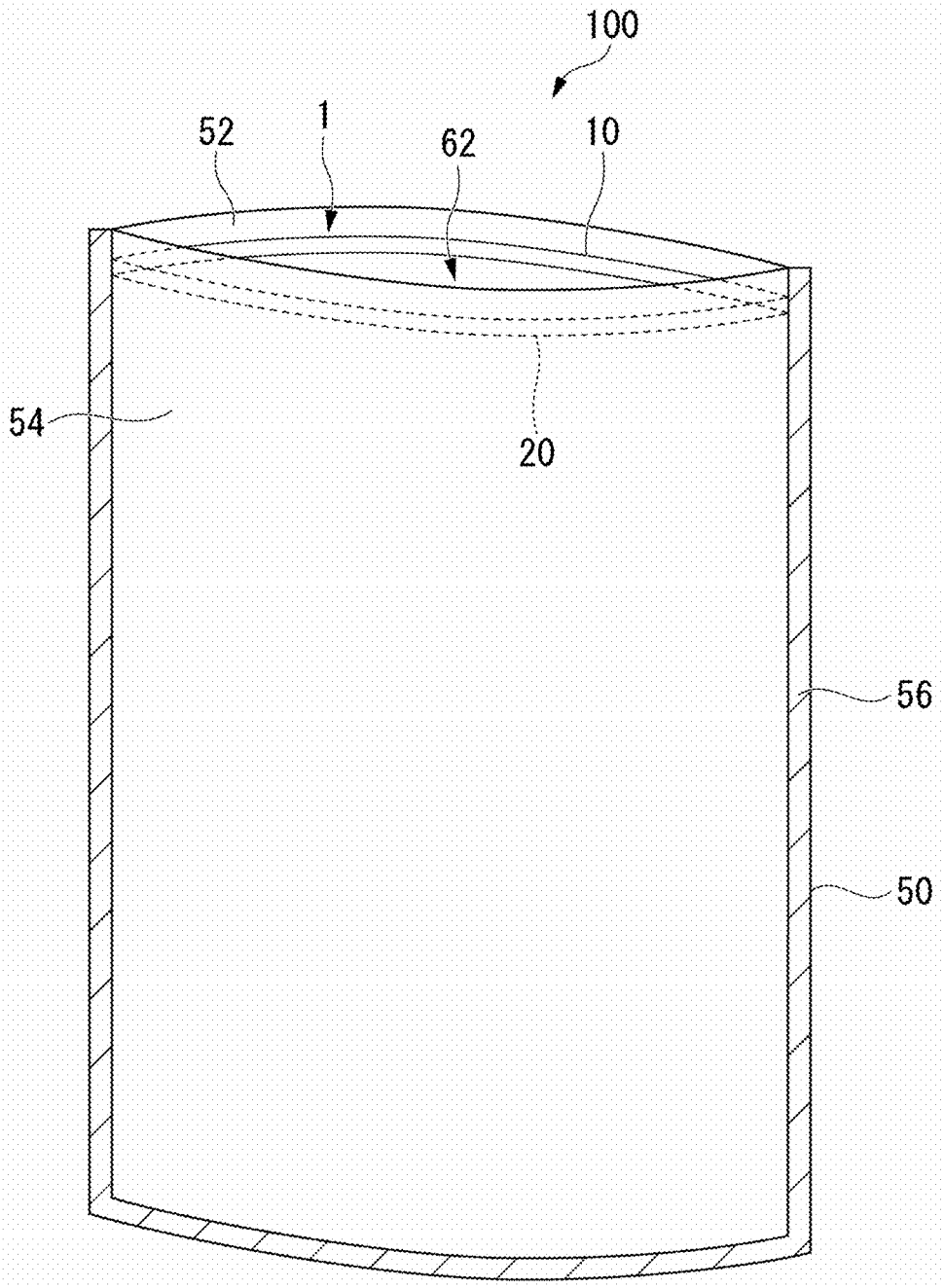
FIG. 4 is a schematic perspective view showing a state in which a bag body 100 is opened.

FIG. 4 is a schematic perspective view showing a state in which the bag body 100 is opened. In the bag body 100, by cutting and removing the upper portion of the bag main body 50 along the cutting assistance line 58 from the notch 60, an end portion not heat-sealed on the upper portion can be provided. The bag body 100 can be opened by opening the end portion to form an opening portion 62.

The opening portion 62 formed in the bag body 100 can be repeatedly opened and closed by attaching and detaching the male side fitting member 10 and the female side fitting member 20 of the fitting tool 1.

The bag body 100 can be manufactured by a known method except that the fitting tool 1 is used.

In the bag body 100 of the present embodiment, since the fitting tool 1 is used, stickiness in the fitting tool disposed on an inner surface of the bag main body 50 is suppressed.

In addition, since the bag body 100 of the present embodiment uses the fitting tool 1, in a case where the first film material 52 and the second film material 54, and the fitting tool 1 are collectively heat-sealed by the peripheral portion 56, defects such as wrinkles or holes are less likely to be generated in a sealed portion, and excellent finishing is easily obtained.

According to the fitting tool 1 having the configuration described above, it is possible to respond to the demand for mono-materialization during recycling.

In addition, according to the fitting-tool-equipped bag body 100 having the configuration described above, by using the fitting tool 1 described above, it is possible to suppress the generation of wrinkles during the bag making and to respond to the demand for mono-materialization.

As described above, although preferred examples of the embodiments according to the present invention have been described with reference to the accompanying drawings, the present invention is not limited to such examples. The variety of shapes, combinations, and the like of the individual constituent members described in the above-described examples are examples, and a variety of modifications are permitted based on design requirements and the like without departing from the gist of the present invention.

Hereinafter, the present invention will be described in detail with reference to Examples, but the present invention is not limited to the following description.

In the present example, resins shown in Table 1 below were used.

TABLE 1

| | MFR (g/10 min) | Density (kg/m$^3$) | Melting point (° C.) | Bending elastic modulus (MPa) | Tensile yield stress (MPa) |
|---|---|---|---|---|---|
| PP1 | 6.0 | 890 | 129 | — | — |
| PP2 | 7.0 | 890 | 83 | — | — |
| LDPE1 | 4.0 | 924 | 113 | — | — |
| LDPE2 | 5.0 | 921 | 108 | — | — |
| LLDPE1 | 15.0 | 910 | 124 | — | — |
| LLDPE2 | 3.5 | 915 | 126 | — | — |
| LLDPE3 | 8.5 | 916 | 120 | — | — |
| LLDPE4 | 1.6 | 897 | 96 | — | — |
| LLDPE5 | 12.1 | 884 | 71 | — | — |
| LLDPE6 | 3.5 | 898 | 90 | — | — |
| HDPE1 | 8.0 | 964 | 131 | 1050 | 29 |
| HDPE2 | 13.0 | 960 | 130 | 1140 | 26 |
| HDPE3 | 5.2 | 964 | 133 | 1240 | 28 |
| HDPE4 | 20.0 | 964 | 131 | 1160 | 27 |
| HDPE5 | 7.9 | 961 | 131 | 1070 | 26 |
| HDPE6 | 5.0 | 965 | 132 | 1130 | 26 |

The resins LDPE1 and LDPE2 and the resins LLDPE1 to LLDPE6 correspond to the "polyethylene (A)" in the present invention.

In addition, the resins HDPE1 to HDPE6 correspond to the "polyethylene (B)" in the present invention.

For each resin, the MFR, the density, the melting point, the bending elastic modulus, and the tensile yield stress are manufacturer's nominal values. The MFR is a value measured with a load of 2.16 kg in accordance with JIS K 7210-1. A measurement temperature of the MFR was 190° C. for an ethylene-based resin and 230° C. for polypropylene-based resins (PP1 and PP2).

Examples 1 to 6, Comparative Examples 1 to 4

Each of the resins shown in Table 1 for the main layer, the seal layer, and the interlayer was weighed and mixed at proportions shown in Table 2 to prepare the polyethylene (A) and the polyethylene (B).

As a resin material for forming the main layer, the polyethylene (A) which was a formulation of the main layer was melt-kneaded at 170° C. using a uniaxial extruder having a diameter of 50 mmϕ and an L/D of 30.

As a resin material for forming the seal layer, the polyethylene (A) which was a formulation of the seal layer was melt-kneaded at 170° C. using a uniaxial extruder having a diameter of 30 mmϕ and an L/D of 30.

As a resin material for forming the interlayer, the polyethylene (B) was melt-kneaded at 190° C. using a uniaxial extruder having a diameter of 30 mmϕ and an L/D of 30.

In Examples 1 to 6, the melt-kneaded molten resin was supplied to a composite shape die having a die shape corresponding to each of the male side fitting member and the female side fitting member, and co-extrusion-molded. The obtained molded product was cooled and solidified in a water tank, and then wound by a winder to obtain a fitting tool of each of Examples 1 to 6.

In the male side fitting member of the obtained fitting tool, a ratio of a resin amount (a resin amount X) of the male side fitting portion and the main layer combined, a resin amount (a resin amount Y) of the interlayer, and a resin amount (a resin amount Z) of the seal layer was [resin amount X]: [resin amount Y]: [resin amount Z]=60:30:10. For the female side fitting member, a ratio of a resin amount of the female side fitting portion and the main layer, a resin amount of the interlayer, and a resin amount of the seal layer was the same as that of the male side fitting member.

In the obtained fitting tool, for both of the male side fitting member and the female side fitting member, a width of a base material (a first base material and a second base material) was 13 mm, a total thickness of each of the first base material and the second base material (excluding the fitting portion) was 0.15 mm, a thickness of the base material was 55 μm, a thickness of the interlayer was 65 μm, and a thickness of the seal layer was 30 μm.

In Comparative Examples 1 to 3, the polyester (A) shown in Table 2 was melt-kneaded at 150° C. to 200° C., which was a temperature 40° C. to 50° C. higher than the melting point of the resins to be blended, using an extruder having a diameter of 50 mmϕ and an L/D of 30 for the main layer and using an extruder having a diameter of 30 mmϕ and an L/D of 30 for the seal layer. It was supplied to a composite shape die having a die shape corresponding to each of the male side fitting member and the female side fitting member, and co-extrusion-molded. The obtained molded product was cooled and solidified in a water tank, and then wound by a winder to obtain a fitting tool of each of Comparative Examples 1 to 3.

In Comparative Example 4, the polypropylene-based resins (PP1, PP2) shown in Table 2 were melt-kneaded at 190° C. using an extruder having a diameter of 50 mmϕ and an L/D of 30 for the main layer and melt-kneaded at 170° C. using an extruder having a diameter of 30 mmϕ and an L/D of 30 for the seal layer. It was supplied to a composite shape die having a die shape corresponding to each of the male side fitting member and the female side fitting member, and co-extrusion-molded. The obtained molded product was cooled and solidified in a water tank, and then wound by a winder to obtain a fitting tool of Comparative Example 4.

<Evaluation Method>

The obtained fitting tool was evaluated by the following methods.

[1. Melting Point of Fitting Tool]

10 mg of the fitting tool was collected as a sample, and put into an aluminum pan, and a melting point was measured by DSC (manufactured by Shimadzu Corporation: DSC-60 Plus). The measurement was carried out in a nitrogen atmosphere at a temperature rising rate of 10° C./min in a range of 0° C. to 170° C.

[2. Recyclability]

Recyclability was evaluated according to the following criteria.

(Determination criteria)

O: The demand for mono-materialization could be met.

x: The demand for mono-materialization could not be met.

[3. Difficulty of Forming Wrinkles]

The fitting tool was laminated on a single-layer film formed of linear low-density polyethylene (LLDPE) to manufacture a fitting-tool-equipped bag body.

The difficulty of forming wrinkles during bag making was evaluated according to the following criteria.

O: The formation of wrinkles in the fitting-tool-equipped bag body could be visually confirmed.

x: The formation of wrinkles in the fitting-tool-equipped bag body could not be visually confirmed.

[4. Rigidity]

Rigidity was evaluated by measuring tensile stress.

The male side fitting member was cut out to have a length of 70 mm to obtain a test piece.

Both ends of the obtained test piece in the longitudinal direction were gripped by a tensile testing machine (manufactured by Toyo Seiki Seisaku-sho, Ltd., VGS5E), and a tensile stress at 2% elongation was measured. A tensile stress was measured for five test pieces, and an arithmetic average value of the measured values was adopted as the tensile stress. A peel strength was measured under conditions of a chuck distance of 50 mm and a test speed of 1 mm/min.

Each evaluation result is shown in Table 2.

REFERENCE SIGNS LIST

1—Fitting tool
10—Male side fitting member
11—First base material
11*a*—Surface
12—Male side fitting portion
13—Main layer
14—Seal layer
15—Interlayer
20—Female side fitting member
21—Second base material
21A—Surface

TABLE 2

| | | | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|---|
| Main layer | PP1 | wt % | | | | | | | | | | 100 |
| | LDPE1 | wt % | 40 | 40 | 40 | 40 | 40 | 40 | 40 | | 50 | |
| | LDPE2 | wt % | | | | | | | | 40 | | |
| | LLDPE1 | wt % | 40 | 40 | 40 | 40 | 40 | 40 | 40 | | | |
| | LLDPE2 | wt % | 20 | 20 | 20 | 20 | 20 | 20 | 20 | | 40 | |
| | LLDPE3 | wt % | | | | | | | | 60 | | |
| | LLDPE4 | wt % | | | | | | | | | 10 | |
| | Total | wt % | 100 | 100 | 100 | 100 | 100 | 100 | 100 | 100 | 100 | 100 |
| Inter-layer | HDPE1 | wt % | 100 | | | | | | | | | |
| | HDPE2 | wt % | | 100 | | | | | | | | |
| | HDPE3 | wt % | | | 100 | | | | | | | |
| | HDPE4 | wt % | | | | 100 | | | | | | |
| | HDPE5 | wt % | | | | | 100 | | | | | |
| | HDPE6 | wt % | | | | | | 100 | | | | |
| | Total | wt % | 100 | 100 | 100 | 100 | 100 | 100 | — | — | — | — |
| Seal layer | PP2 | wt % | | | | | | | | | | 40 |
| | LLDPE5 | wt % | 100 | 100 | 100 | 100 | 100 | 100 | 100 | 100 | 100 | |
| | LLDPE6 | wt % | | | | | | | | | | 60 |
| | Total | wt % | 100 | 100 | 100 | 100 | 100 | 100 | 100 | 100 | 100 | 100 |
| Weight ratio of each layer (base material/interlayer/seal layer) | | | 60/30/10 | 60/30/10 | 60/30/10 | 60/30/10 | 60/30/10 | 60/30/10 | 80/—/20 | 80/—/20 | 90/—/10 | 89/—/11 |
| Melting point | | ° C. | 133 | 130 | 133 | 131 | 131 | 132 | 110 | 123<br>110 | 115 | 130 |
| Recyclability | | Evaluation | ○ | ○ | ○ | ○ | ○ | ○ | ○ | ○ | ○ | x |
| Difficulty of wrinkles to form | | Evaluation | ○ | ○ | ○ | ○ | ○ | ○ | x | x | x | ○ |
| Rigidity (inclination to elongation 2%) | | N/mm | 8.8 | 8.7 | 8.9 | 9.2 | 8.6 | 8.9 | 4.8 | 4.4 | 3.5 | 8.3 |
| | | Evaluation | ○ | ○ | ○ | ○ | ○ | ○ | x | x | x | ○ |

As a result of the evaluation, the fitting tools of Examples 1 to 6 can respond to the demand for mono-materialization and have excellent recyclability.

In addition, it was found that the fitting tools of Examples 1 to 6 had sufficient rigidity and could suppress the generation of wrinkles during the bag making.

On the other hand, the fitting tools of Comparative Examples 1 to 3 had excellent recyclability, but had insufficient rigidity, and could not suppress the generation of wrinkles at the time of manufacturing a fitting-tool-equipped bag body.

The fitting tool of Comparative Example 4 had sufficient rigidity and could suppress the generation of wrinkles during the bag making, but could not meet the demand for mono-materialization and had poor recyclability.

From the above results, it was found that the present invention was useful.

22—Female side fitting portion
23—Main layer
24—Seal layer
25—Interlayer
50—Bag main body
100—Fitting-tool-equipped bag body

The invention claimed is:

1. A fitting tool comprising:

a male side fitting member in which a male side fitting portion is provided on a surface of a band-shaped first base material along a longitudinal direction; and a female side fitting member in which a female side fitting portion is provided on a surface of a band-shaped second base material along the longitudinal direction, wherein the male side fitting portion and the female side fitting portion are detachably fit, each of the first base material and the second base material includes a main layer, a seal layer provided on a side of the main layer opposite the male side fitting portion and the female side fitting portion, and an interlayer provided between the main layer and the seal layer, both the first base material and the second base material are formed of a polyethylene-based resin obtained by polymerizing a monomer containing ethylene, the main layer contains low-density polyethylene and linear low-density polyethylene, the interlayer contains high-density polyethylene, the seal layer contains linear low-density polyethylene, the polyethylene-based resin of the interlayer has a density of 930 $kg/m^3$ or more and 1000 $kg/m^3$ or less, the density of the polyethylene-based resin of the interlayer is at least 1.01 times the density of the polyethylene-based resin of the main layer, and a rigidity obtained by the following measurement method is 5 to 30 N/mm,

[Rigidity]

the male side fitting member is cut out to have a length of 70 mm to obtain a test piece, both ends of the obtained test piece in the longitudinal direction are gripped by a tensile testing machine, and a tensile stress at 2% elongation is measured, a tensile stress is measured for five test pieces, and an arithmetic average value of measured values is adopted as the tensile stress (rigidity), and a peel strength is measured under conditions of a chuck distance of 50 mm and a test speed of 1 mm/min.

2. The fitting tool according to claim 1, wherein the rigidity is 7 to 15 N/mm.

3. The fitting tool according to claim 1, wherein the polyethylene-based resin forming the interlayer has a melting point of 125° C. or higher.

4. A fitting-tool-equipped bag body comprising:

the fitting tool according to claim 1; and a bag main body that accommodates a content, wherein the bag main body is formed of a polyethylene-based resin obtained by polymerizing a monomer containing ethylene, and the fitting tool is attached to an inner surface of the bag main body.

5. The fitting tool according to claim 1, wherein a melt flow rate of the polyethylene-based resin of the interlayer is 4.0 g/10 min or more, a flexural modulus of the polyethylene-based resin of the interlayer is 1000 MPa or more, and a tensile yield stress of the polyethylene-based resin of the interlayer is 20 MPa or more.

6. The fitting tool according to claim 1, wherein mass ratios of the main layer, the seal layer, and the interlayer in the entire fitting tool are, relative to a total mass of the fitting tool, 50 mass % or more and 85 mass % or less for the main layer, 8 mass % or more and 20 mass % or less for the seal layer, and 10 mass % or more and 45 mass % or less for the interlayer, with a total being 100 mass %.

* * * * *